US006350220B1

(12) United States Patent
Milburn et al.

(10) Patent No.: US 6,350,220 B1
(45) Date of Patent: Feb. 26, 2002

(54) WEIGHTLIFTING DEVICE AND METHOD

(75) Inventors: Stephen Douglas Milburn; Michel Joseph Courchesne, both of Hamilton; Thomas Joseph Andreatta, Stoney Creek, all of (CA)

(73) Assignee: Afterburner Fitness Inc., Hamilton (CA)

( * ) Notice: Subject to any disclaimer, the term of this patent is extended or adjusted under 35 U.S.C. 154(b) by 0 days.

(21) Appl. No.: 09/407,296

(22) Filed: Sep. 29, 1999

(51) Int. Cl.[7] ..... A63B 21/062

(52) U.S. Cl. ..... 482/98; 482/5; 482/9; 482/94

(58) Field of Search ..... 482/5, 8, 9, 93, 482/94, 97–103

(56) References Cited

U.S. PATENT DOCUMENTS

| | | | | |
|---|---|---|---|---|
| 4,176,836 A | | 12/1979 | Coyle | |
| 4,253,662 A | | 3/1981 | Polodak | |
| 4,257,593 A | | 3/1981 | Keiser | |
| 4,354,675 A | | 10/1982 | Barclay et al. | |
| 4,531,727 A | | 7/1985 | Pitre | |
| 4,609,189 A | | 9/1986 | Brasher | |
| 4,627,615 A | | 12/1986 | Nurkowski | |
| 4,650,185 A | | 3/1987 | Cartwright | |
| 4,919,418 A | * | 4/1990 | Miller | 482/5 |
| 5,011,142 A | | 4/1991 | Eckler | |
| 5,020,794 A | * | 6/1991 | Englehardt et al. | 482/5 |
| 5,029,849 A | | 7/1991 | Nurkowski | |
| 5,037,089 A | * | 8/1991 | Spagnuolo et al. | 482/5 |
| 5,331,851 A | * | 7/1994 | Parviainen et al. | 482/5 |
| 5,393,285 A | | 2/1995 | Fischer, Sr. et al. | |
| 5,542,897 A | | 8/1996 | Hall | |
| 5,643,151 A | | 7/1997 | Naimo | 482/98 |
| 5,842,957 A | | 12/1998 | Wheeler | |

FOREIGN PATENT DOCUMENTS

| | | | | |
|---|---|---|---|---|
| DE | 3410068 | * | 10/1985 | 482/93 |
| FR | 2700269 | * | 7/1994 | 482/94 |

* cited by examiner

*Primary Examiner*—John Mulcahy
(74) *Attorney, Agent, or Firm*—Gowling Lafleur Henderson LLP

(57) ABSTRACT

A device for retrofitting onto or incorporating into a conventional weightlifting machine is provided. The device includes a charge tank and a load tank and a set of hoses for communicating fluid between the tanks. The load tank rests atop a conventional weight stack, while the charge tank rests on the floor proximal to the weightlifting machine. A fluid control means is provided for alternatively filling the load tank with water stored in the charge tank and draining the fluid back into the charge tank from the load tank, as desired. Before an exercise, the load tank is filled with water using the fluid control means. During the exercise, the fluid control means is set to allow water to drain back into the charge tank. The flow rate is set, either manually or through the use of a computer-controller, so that the weight-lifter is lifting his maximum capacity of weight during each repetition.

13 Claims, 17 Drawing Sheets

WEIGHTLIFTING DEVICE AND METHOD

FIELD OF THE INVENTION

The present invention relates generally to exercise equipment and more particularly relates to weightlifting machines.

BACKGROUND OF THE INVENTION

It is known that in order to accomplish an increase in the strength and/or mass of a muscle, the muscle must generally be overloaded. The most common way to achieve muscle overload is through repetitive lifting of weights, sometimes referred to as resistance training. Weight lifting machines are commonly used in resistance training, where the amount of weight is fixed at an amount less than the weightlifting capacity of the weight-lifter. As the weight-lifter progresses through his repetitions, the muscles eventually fatigue. The muscles generally reach their capacity only during the last few repetitions. Thus, several sets of repetitions can be necessary for appropriate muscle building, making the first few repetitions wasteful.

As used herein, 'weightlifter's capacity' and 'weightlifting capacity' generally refers to the maximum amount of weight a weight-lifter can lift, once, on a given weightlifting machine, before muscle fatigue prevents another repetition of the same amount of weight. A weightlifter's muscles are generally overloaded when the weightlifter exceeds capacity. By slightly exceeding capacity, and just entering muscle overload, a weightlifter may only complete a partial repetition while generally maximizing the strengthening of the muscle.

Attempts to reduce or eliminate the initial, inefficient repetitions employ systems that begin at a weight at the weightlifter's capacity, and reduce the amount of weight throughout the exercise. This can be achieved, for example, by having assistants remove weights in ten to twenty-five pound decrements as a weight-lifter is performing the exercise. However, each decrement is not likely to correspond with the weightlifter's reduced capacity due to the muscle fatigue caused by the previous repetition. Further, the awkwardness, potential dangers and inefficiency of this procedure are apparent to the person skilled in the art.

Another attempt to vary the weight during conventional weight training is found in U.S. Pat. No. 4,531,727 to Pitre. Pitre teaches a weight training machine in which a tension line is attached to a vessel filled with a fluid, which provides resistance when pulled at the opposite end by a weight-lifter. During the course of the exercise, the fluid drains from the vessel and the weight is reduced. Unfortunately the weight training machine of Pitre is comprised of a complex, somewhat awkward system, with an overall unfamiliar structure that radically varies from conventional weight lifting machines. Although Pitre can provide a more efficient workout, it is believed that the unfamiliar structure of the machine in Pitre can lead to a consumer reluctance to change from conventional weightlifting machines to the machine taught in Pitre. Additionally, gymnasiums using the Pitre machine must purchase an entire machine, thus increasing cost and occupying valuable floor space.

Another disadvantage with Pitre is that the fluid in the vessel drains to near empty during the exercise, which can undershoot the weightlifter's capacity during the final repetitions. Further, the decrement may not correspond with the weightlifter's capacity. By the same token, the vessel in Pitre is awkward to fill to the weightlifter's capacity. Thus, a weightlifter using the machine taught in Pitre does not necessarily maximize the fill efficiency of his workout. It will also be apparent that particularly strong weightlifters will require very large fluid vessels, making the machine even more awkward.

Other prior art include U.S. Pat. No. 5,842,957 to Wheeler and U.S. Pat. No. 4,531,727 to Eckler. Wheeler teaches a hollow dumbbell filled with water that reduces in weight throughout the course of the exercise as the water drains. However, the wheeler was designed primarily to be used in conjunction with bodies of water, as the dumbbell must be submerged in water to be filled prior to each use. Additionally, the reduction in the weight of the dumbbell was designed to make it safer to put down after the exercise, and does not teach flow rates to produce a more efficient workout. Eckler teaches fluids in a hydraulic system to produce a more efficient workout through isodynamic resistance. Although Eckler can incorporate a system to select different weight training modes, none achieve a reduction in the amount of weight throughout the course of the exercise. Additionally, the use of hydraulic fluids can be expensive, environmentally unfriendly and entail additional maintenance.

SUMMARY OF THE INVENTION

It is therefore an object of the invention to provide a novel weight lifting apparatus which obviates or mitigates at least one of the disadvantages of the prior art.

A device for retrofitting onto or incorporating into a conventional weightlifting machine is provided. The device includes a charge tank and a load tank and a set of hoses for communicating fluid between the tanks. The load tank rests places or supplements a number of weights in a conventional weight stack, while the charge tank rests on the floor proximal to the weightlifting machine. A fluid control means is provided for alternatively filling the load tank with water stored in the charge tank and draining the fluid back into the charge tank from the load tank, as desired. Before an exercise, the weight stack is set to a base load and the load tank is filled with water using the fluid control means. During the exercise, the fluid control means is set to allow water to drain back into the charge tank. The flow rate is set to drain the load tank, either manually or automatically, so that the weight-lifter is lifting a desired amount of weight during each repetition. Preferably, the flow rate, in pounds per minute, is proportional to the muscle fatigue of the weightlifter.

In another embodiment of the invention, a method is provided for performing weight training, comprising the steps of:

performing an initial repetition at a first predetermined weight, the first predetermined weight being the capacity of a weight lifter during the initial repetition; and performing at least one additional repetition at a second predetermined weight less than the first predetermined weight, the second predetermined weight being substantially equal to a reduced capacity of the weight lifter, the reduced capacity resulting from muscle fatigue due to a previous repetition.

BRIEF DESCRIPTION OF THE DRAWINGS

The present invention will now be described, by way of example only, with reference to certain embodiments and the accompanying figures, in which:

FIG. 22 is a perspective view of a adaptor plate of FIG. 21;

DETAILED DESCRIPTION OF THE INVENTION

Figure 1:
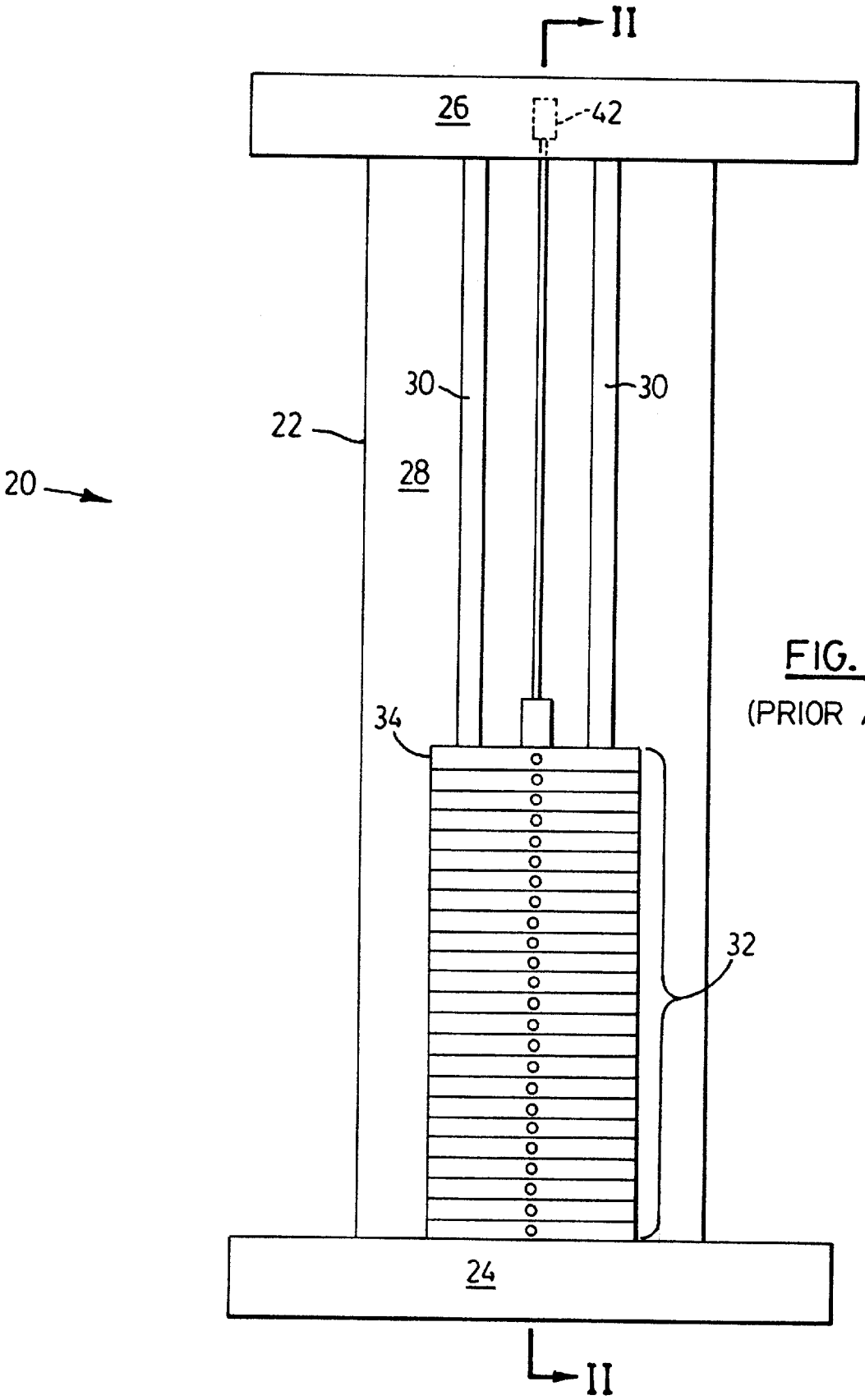
FIG. 1 (PRIOR ART)
FIG. 1 is front view of a prior art weightlifting machine.
Figure 2:
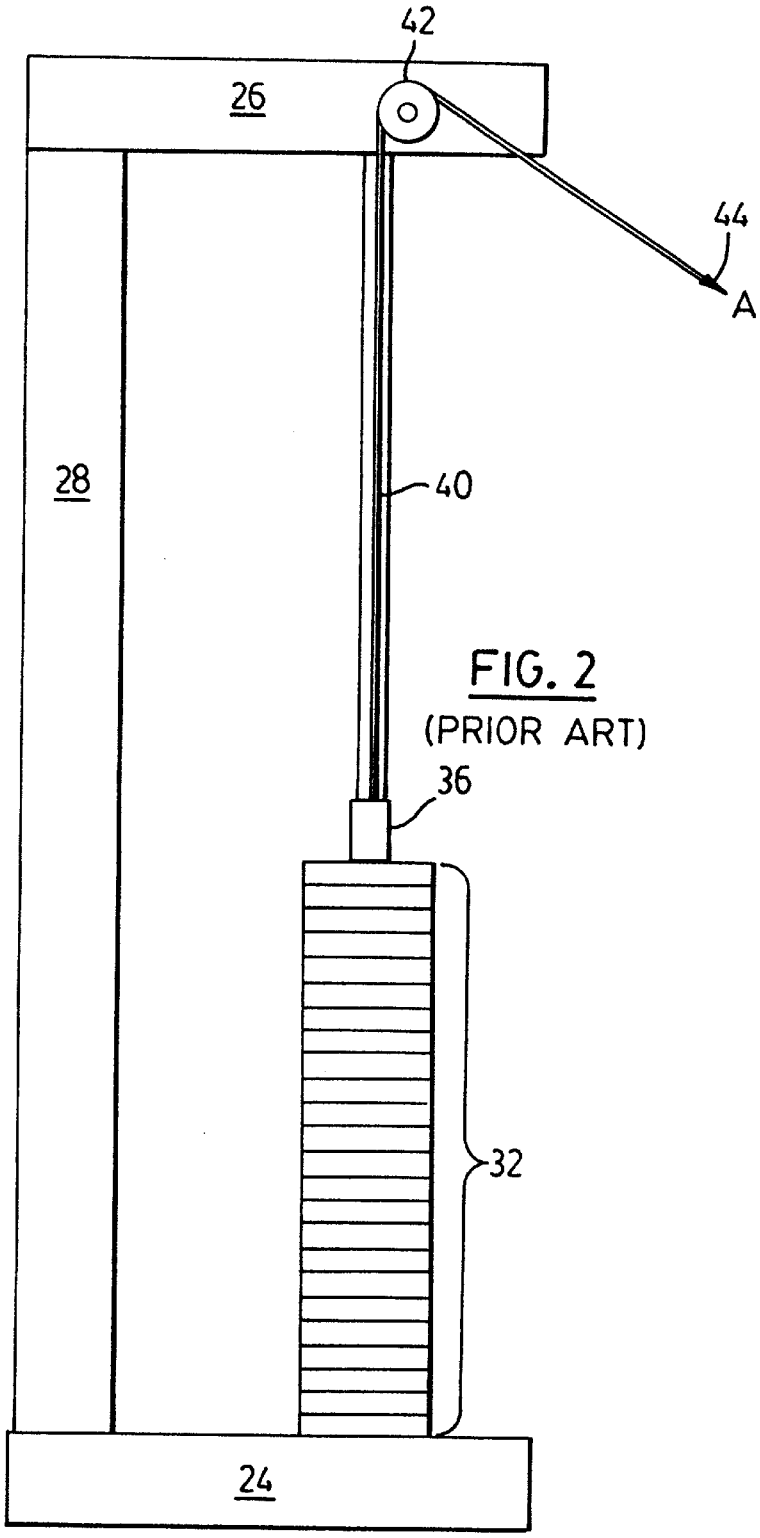
FIG. 2 (PRIOR ART)
FIG. 2 is a side view through line II-II of the prior art weightlifting machine of FIG. 1.

Before discussing embodiments of the present invention, a prior art exemplary weight lifting machine will be discussed. Referring now to FIGS. 1–4, a conventional weight-lifting machine 20 comprises a frame 22, preferably made from steel, having a base 24 and a support arm 26 joined by an intermediate support member 28. A pair of guide shafts 30 extend between support arm 26 and base 24 in a substantially parallel relation to member 28. A stack 32 of weights 34 is slidable along guide shafts 30, each weight 34 having a pair of shaft apertures 35 being slightly larger than their respective shaft 30. Machine 20 further includes a selector rod 36 which passes through a bar aperture 38 on each weight 34. A tension line 40 is affixed to the end of rod 36 closest to support arm 26, and passes over a rotatable pulley 42 affixed to support arm 26 and extends past machine 20. The free-end 44 of line 40 can be attached to any type of mechanical interface usable by a weight-lifter, such as a T-bar used for pull-downs or handle bars used as a bench press. Other mechanical interfaces as will occur to those of skill in the art.

Figure 4:
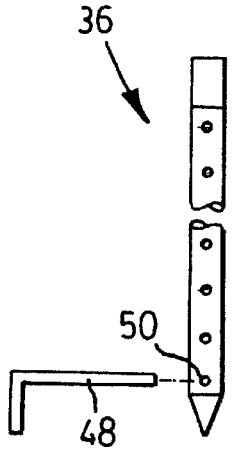
FIG. 4 (PRIOR ART)
FIG. 4 is front view of a prior-art guide-rod used in the machine of FIG. 1.
Figure 3:
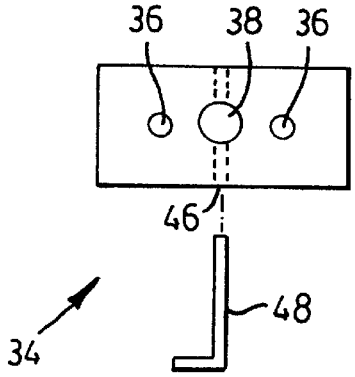
FIG. 3 (PRIOR ART)
FIG. 3 is a top view of a prior-art weight used in the weight-stack of the machine of FIG. 1.

As best seen in FIG. 3, each weight 34 is substantially block-shaped and typically weighs about ten pounds. Weights 34 further include a socket 46 which passes through weight 34 in a direction substantially perpendicular to bar aperture 38. As best seen in FIG. 4, selector rod 36 also includes a plurality of sockets 50 which pass through rod 36 in a direction substantially perpendicular to the length of rod 36. Sockets 50 are equally spaced, such that they each align with the socket 46 of their respective weight 34 when rod 36 passes through stack 32. Sockets 46 and sockets 50 are intended to receive a selector pin 48 which affixes the corresponding weight 34 to rod 36. Other prior art machines can have different configurations of selector pins 48 and weights 34, as known to those of skill in the art.

In order to operate prior art machine 20, an amount of weight to be lifted can be selected by inserting a selector pin 48 into one of the sockets 46, thereby affixing the weight 34 associated with the selected socket 46 to selector rod 36. Next, using the mechanical interface attached to end 44, a weightlifter pulls tension line 40 in direction "A" to lift the affixed weight 34 and the portion of stack 32 between the affixed weight 34 and tension line 40. Next the tension line 40 is released, thereby lowering the weight stack. A weight-lifter can effect resistance training by selecting an amount of weight and repeatedly lifting and lowering the selected portion of stack 32.

Figure 5:
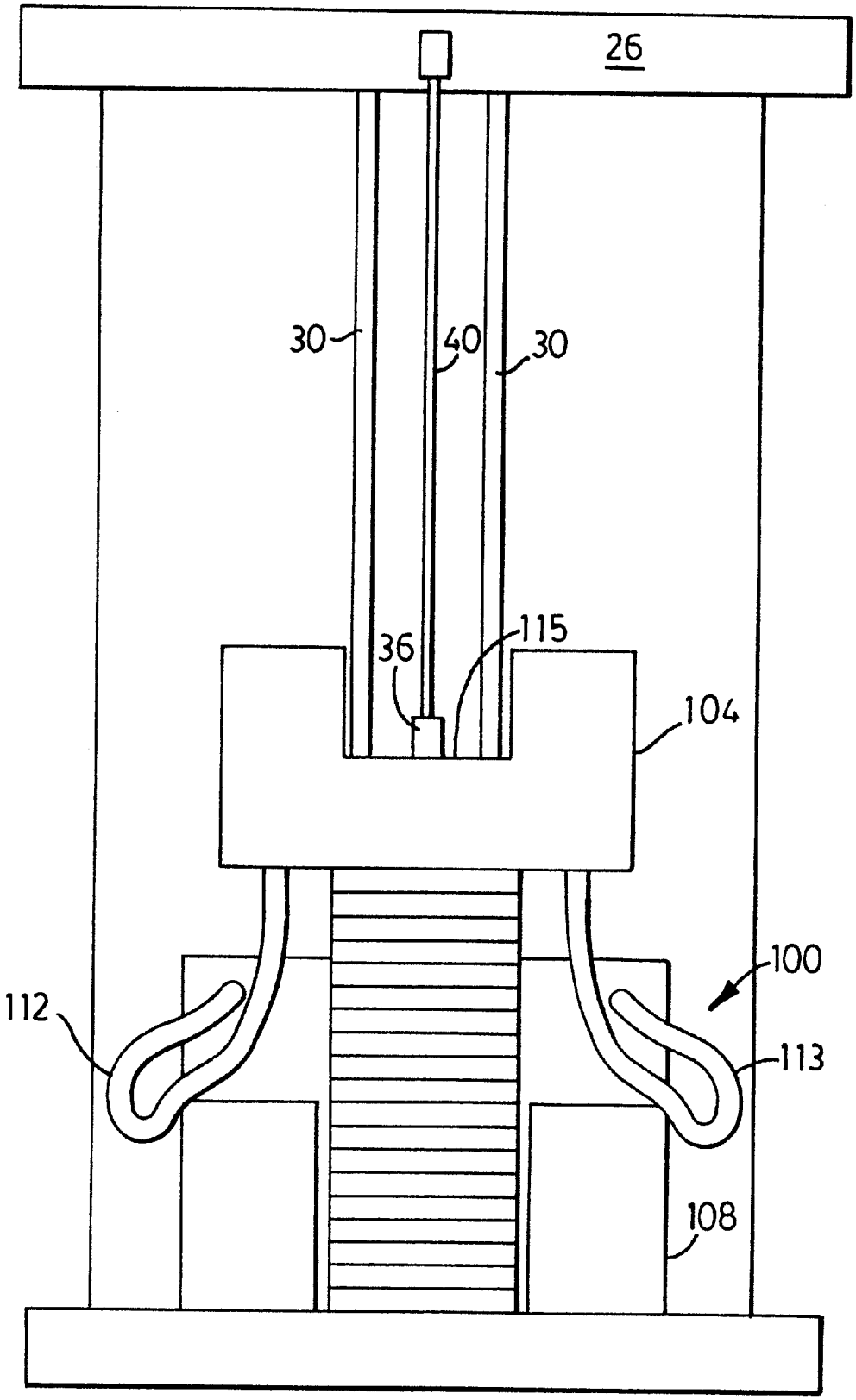
FIG. 5 is a front view of a weightlifting device, in the lowered position, in accordance with an embodiment of the invention.
Figure 6:
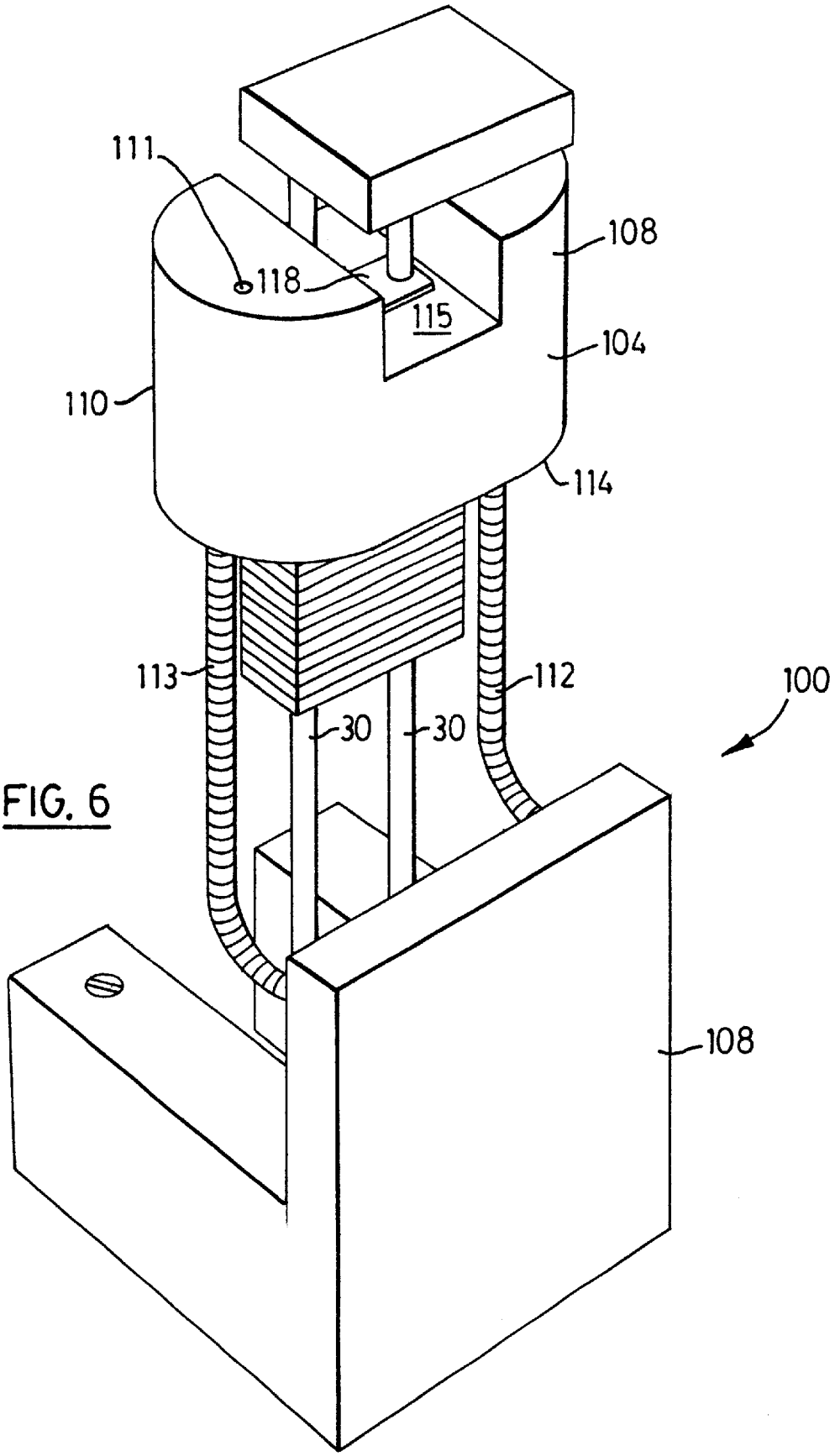
FIG. 6 is a partial rear perspective view of the device of FIG. 5, shown in the raised or lifted position.
Figure 7:
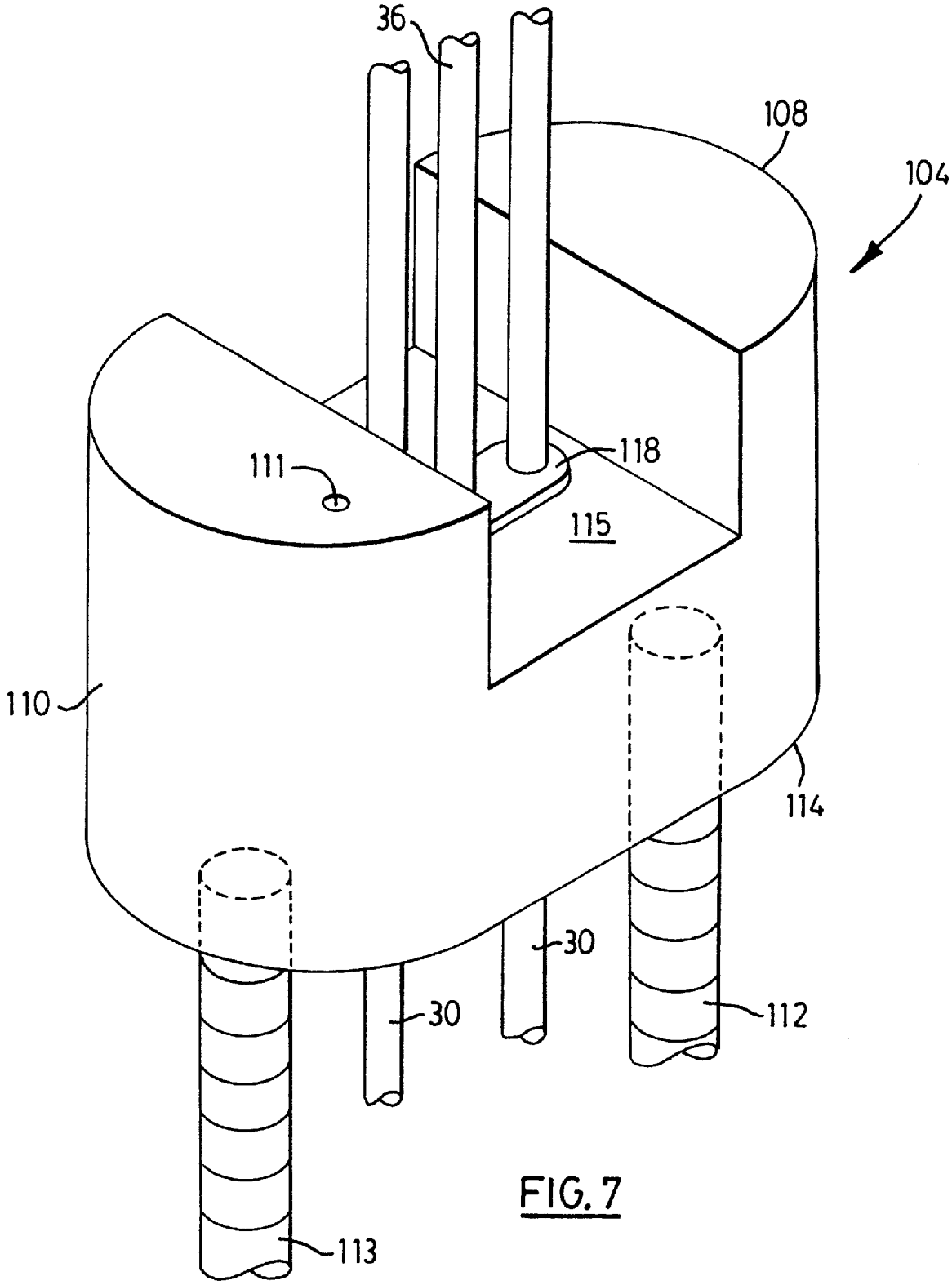
FIG. 7 is a rear perspective view of the load tank of the device of FIG. 5.
Figure 8:
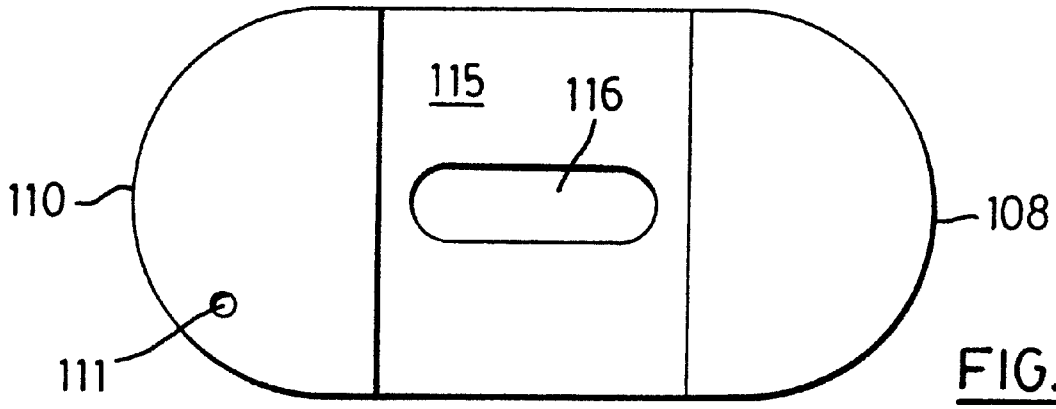
FIG. 8 is a top view of the load tank of FIG. 7.
Figure 9:
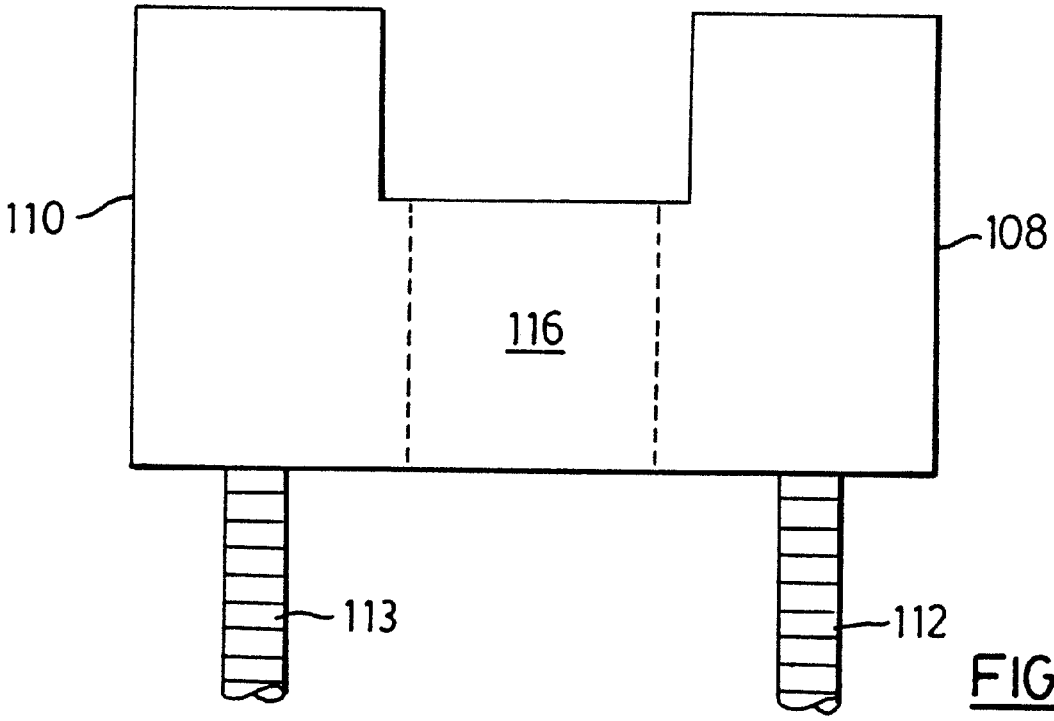
FIG. 9 is a rear view of the load tank of FIG. 8.

Having discussed a prior art weight lifting machine, embodiments of the present invention will now be discussed. Referring now to FIGS. 5 and 6, a device 100 for fitting onto machine 20 includes a fluid source or a load tank 104 and a charge tank 108 which are interconnected by a pair of flexible hoses 112, 113. As seen in FIGS. 5-9, load tank 104 is a hollow vessel for the storage of about one-hundred-pounds of liquid, preferably water. Load tank 104 is preferably made from acetate but it will be understood that any suitable material can be used. In a present embodiment, load tank 104 is oblong, having rounded ends 108, 110 and a generally planar bottom 114 for abutment with the uppermost weight 34 of stack 32. (While not shown in the figures, a layer of shock absorbent material such as foam can be placed between load tank 104 and the upper most weight 34.) Hoses 112, 113 are connected to bottom 114 proximal to each end 108, 110, respectively. In a present embodiment, each hose 112, 113 provides bidirectional fluid communication between load tank 104 and change tank 108. The upper portion of load tank 104 has a small aperture 111 for equalizing air pressure within load tank 104 during filling and emptying thereof. Load tank 104 includes a recessed central portion 115 defined by a central aperture 116 which passes through load tank 104 and through which guide shafts 30 and selector rod 36 passes. Overall, load tank 104 is configured to rest on the uppermost weight 34 of stack 32 in a substantially balanced manner. Notwithstanding the specific shape and configuration of load tank104 that is discussed in the present embodiment, it will be understood that load tank 104 can have a variety of shapes and configurations. For example, load tank 104 can made from two U-shaped halves which are placed on top of the uppermost weight 34, thus obviating the need to disassemble machine 20 if retrofitting load tank 104 to an existing machine 20.

Figure 10:
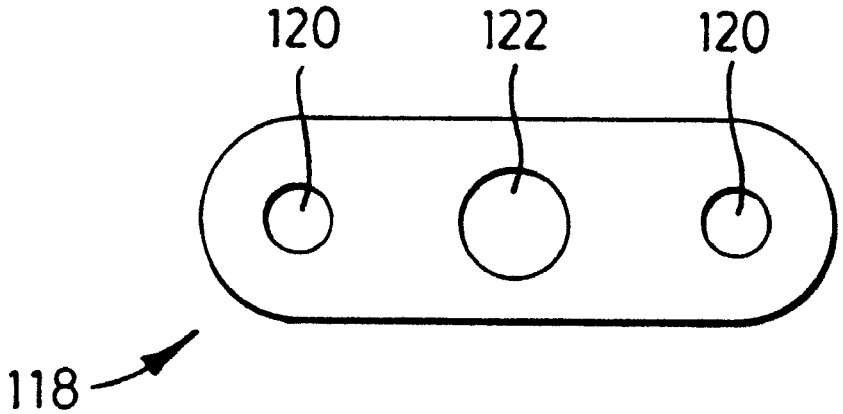
FIG. 10 is a top view of the adapter-plate used on the load tank of FIG. 5.
Figure 11:
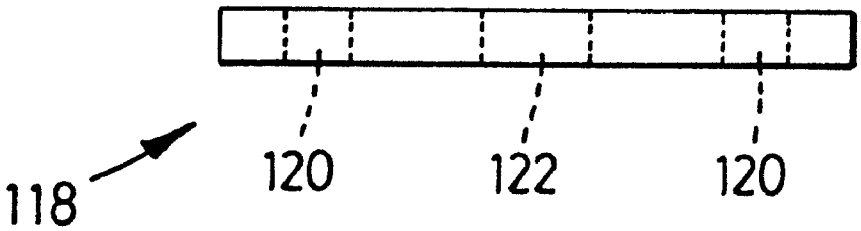
FIG. 11 is a front view of the adapter-plate of FIG. 10.
Figure 12:
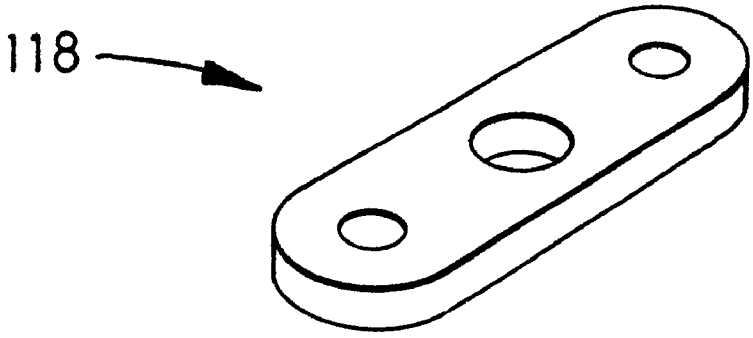
FIG. 12 is a perspective view of the adapter-plate of FIG. 10.
Figure 13:
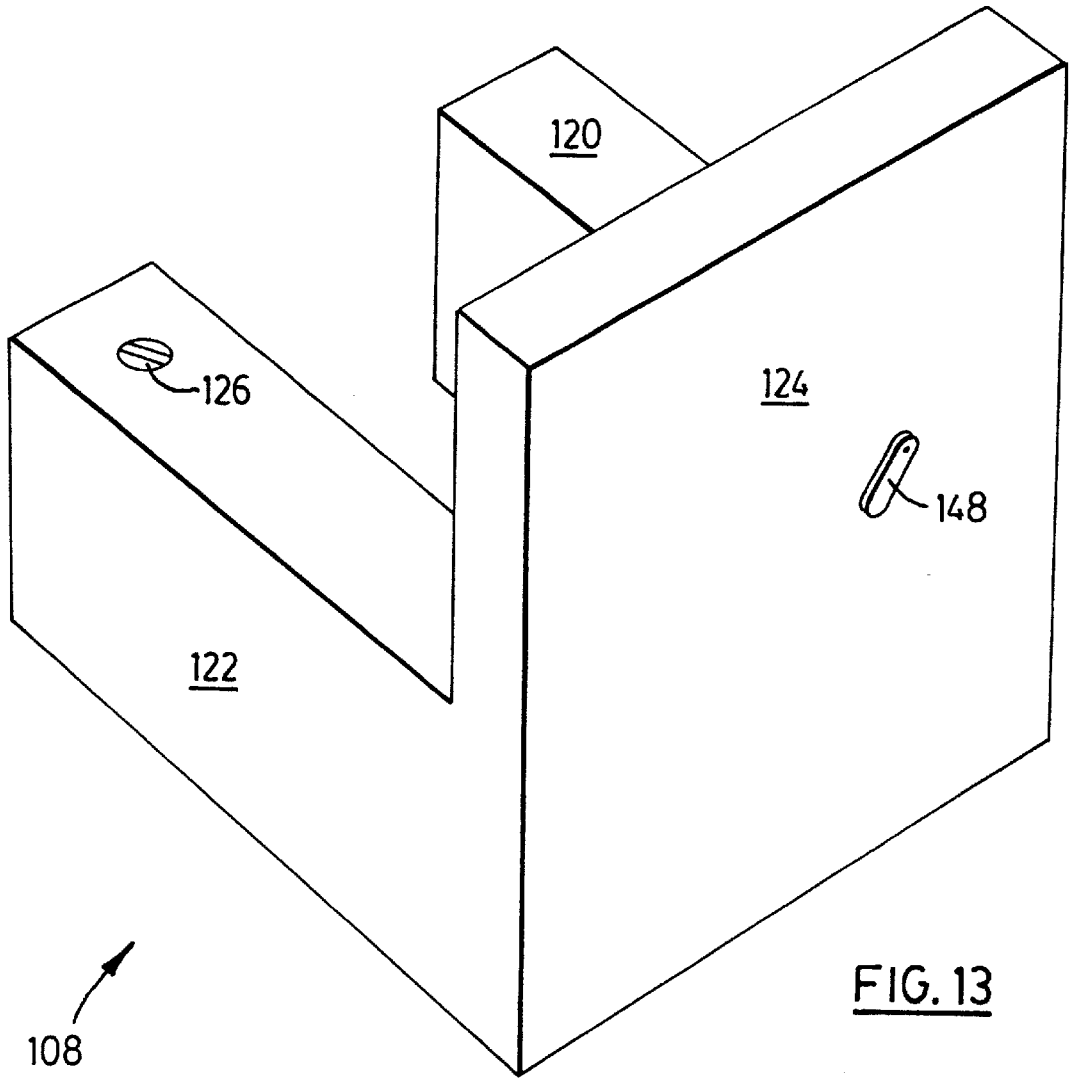
FIG. 13 is a rear perspective view of the charge tank of the device of FIG. 5.
Figure 15:
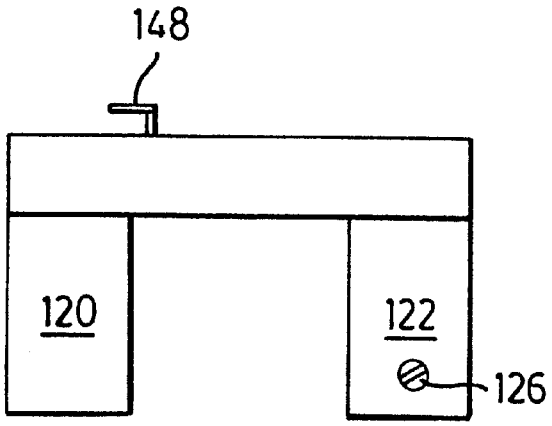
FIG. 15 is a top view of the charge tank of FIG. 14.
Figure 14:
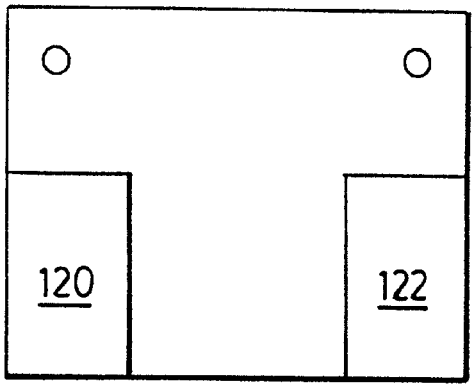
FIG. 14 is a front view of the charge tank of the device of FIG. 13.

As best seen in FIGS. 10–12, a guide plate 118 is also provided having an exterior shape slightly smaller than central aperture 116 and fits therein via a friction fit. Guide plate 118 also includes a pair of shaft apertures 119 and a selector rod aperture 121 to receive shafts 30 and selector rod 36 respectively. In a present embodiment, guide plate 118 is made from nylon, however other suitable materials will occur to those of skill in the art. It will now be apparent that different guide plates 118, having suitably modified apertures, can be provided where it is desired to fit device 100 on machines having different configurations of guide shafts and selector rods. It will be further apparent that central aperture 116 and guide plate 118 can also have different shapes and means of attachment, as desired. Alternatively, guide plate 118 can be formed integrally with load tank 104, and/or it can be located on bottom 114. It is presently preferred that load tank 104 is provided with two guide plates 118 for use in central aperture 116 to provide improved stability, and that load tank 104 is offered for use with a variety of configurations of guide plates 118 so that load tank 104 can be fitted onto a variety of different weightlifting machines.

Figure 16:
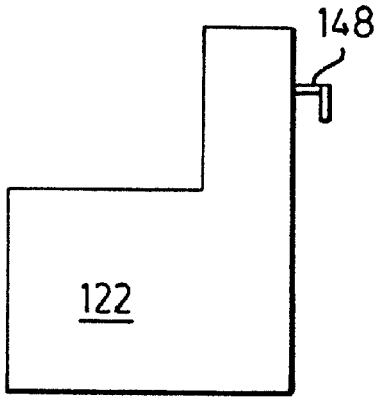
FIG. 16 is a side view of the charge tank of FIG. 14.

Referring now to FIGS. 13–16, charge tank 108 is configured to fit on the base 24 and around weights 34. In a present embodiment, the charge tank 108 is made of fibreglass and can hold about one-hundred-pounds of water or other suitable liquid. As viewed from the top in FIG. 15, tank 108 is generally horseshoe-shaped and as viewed from the side in FIG. 16, is substantially L-shaped. Tank 108 has a two side portions 120, 122 and a raised portion 124 which resides intermediate stack 32 and support member 28. A cap 126 is fitted onto a fill-opening on side portion 122, which can be removed to fill charge tank 108 with water or other suitable fluid.

Figure 17:
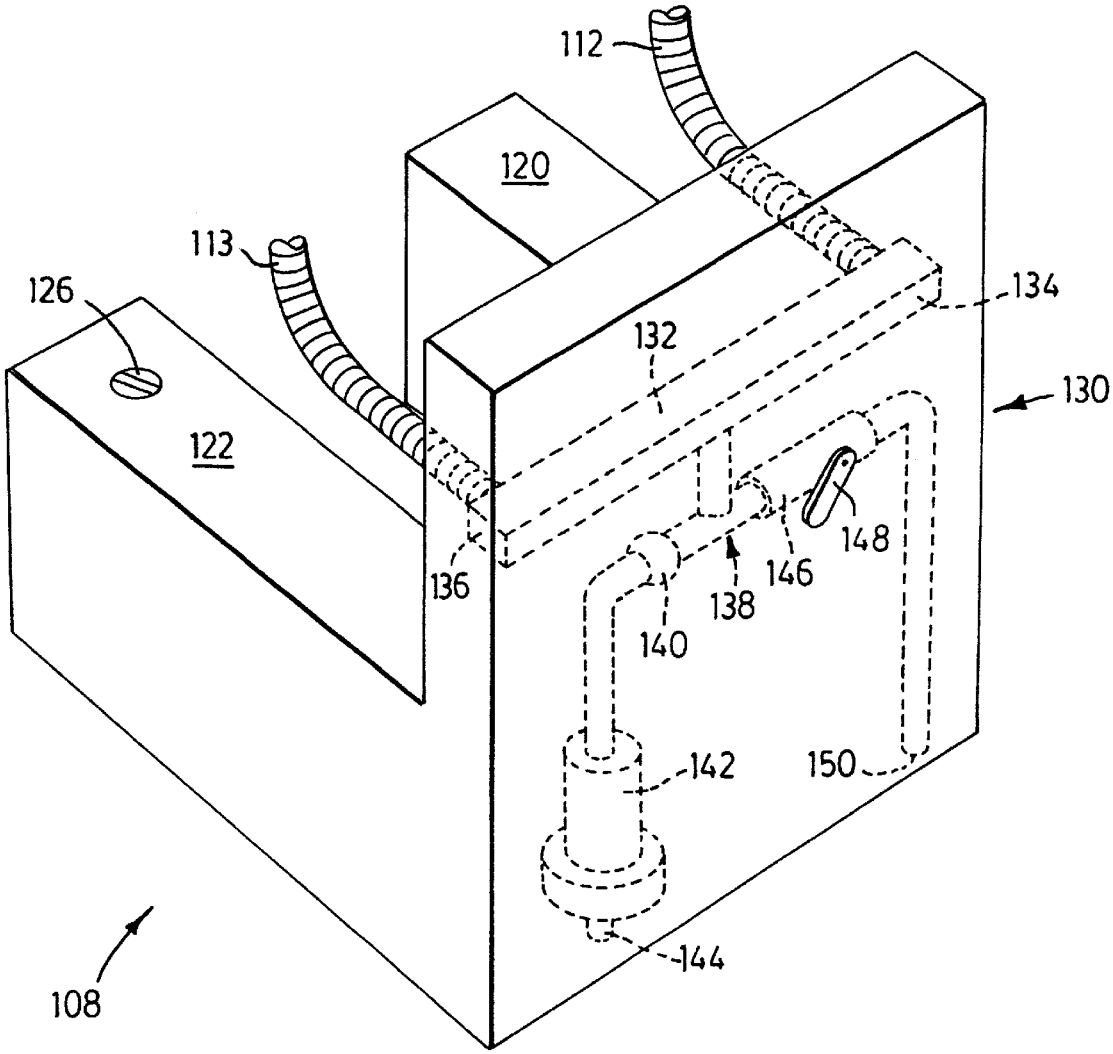
FIG. 17 is a rear perspective view of the charge tank of the device of FIG. 5 showing, in dashed-lines, a fluid-control means housed within the charge tank.
Figure 18:
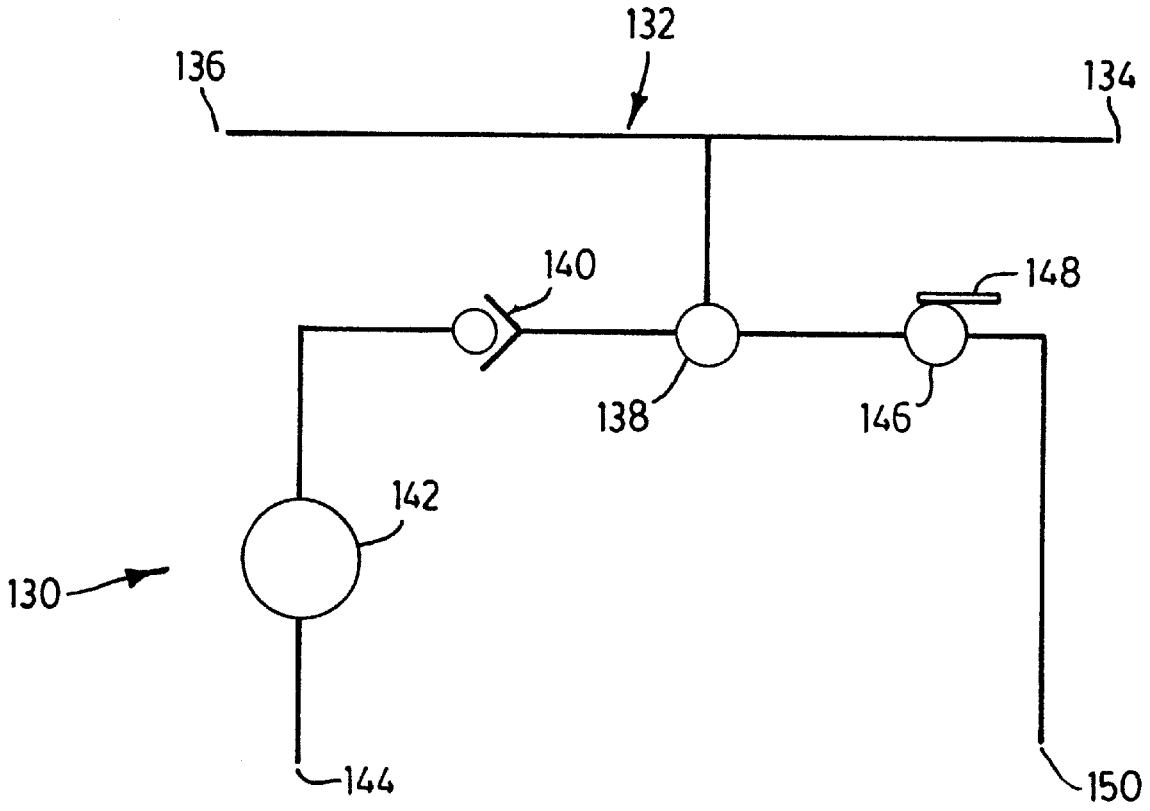
FIG. 18 is a schematic diagram of the fluid-control means of FIG. 17.

Referring now to FIGS. 17 and 18, a fluid control means 130 resides within charge tank 108 and interconnects hoses 112,113 with the interior of charge tank 108, and controls the flow of fluid or liquid between load tank 104 and charge tank 108. Fluid control means 130 includes a hollow header 132 which resides within raised portion 124 and is connected at each of its ends 134, 136 to hoses 112, 113 respectively.

Header 132 is connected to a tee-connection 138 which branches in a first direction towards a check valve 140, which in turn is connected to a pump 142. It will be understood that any known check valve 140 or mechanical equivalent can be used. In a present embodiment, the pump 142 is an electrically powered ¼–⅓ horse-power sump pump. (One suitable type of sump-pump is made by Mastercraft, part number 62-3515, sold by Canadian Tire Corporation, 839 Yonge Street, Toronto, Ontario.) The electrical connection and switch attached therewith are not shown. Pump 142 preferably resides within the lower portion of charge tank 108, and has an inlet 144 to draw fluid from the interior of tank 108. Collectively, pump 142, check valve 140 and inlet compose a fluid-fill mechanism.

Tee-connection 138 branches in a second direction towards a ball-valve 146 or any other suitable type of regulating valve. In a present embodiment, ball-valve 146 is actuated with a handle 148, which extends to the exterior of charge tank 108 to allow operation of ball-valve 146. It will be understood that other means of actuating ball-valve 146 (and positions of such means) are within the scope of the invention, and can be achieved by modifying the present invention. For example, it may be desired to locate handle 148 on the top of portion 124 to facilitate easier access of handle 148.

Ball-valve 146 is also connected to an outlet 150, which is also resident within the lower portion of charge tank 108, which can assist in providing a syphon when load tank 104 is being drained. Collectively, ball valve 146 and outlet 150 compose a fluid-drain mechanism.

Each of the above-described components of fluid control means 130 is interconnected by 1.25 inch pipe made from polyvinyl-chloride or ABS. In general, it will be understood that any of the components of fluid control means 130 can be obtained from off-the-shelf parts, and can be modified, and that such modifications are within the scope of the invention.

Where used herein, terms such as "vertical", "horizontal", "upper", "lower", "top" and "bottom" refer to the items as shown in the Figures, and as such are not to be construed in a limiting sense.

In operation, stack 32 begins in the lowered position shown in FIG. 5. Load tank 108 is full of water. A weight-lifter selects a desired amount of weight on stack 32 using the previously-described method of the prior art. It is presently preferred that the weight-lifter should select an amount of weight on stack 32, which, when combined with the weight of load tank 104 when it is full, substantially equals his maximum capacity or maximum amount of weight he can lift in his first repetition. However, any desired weight can be chosen.

Valve 146 is placed in the closed-position to cut-off fluid communication between header 132 and outlet 150. Next, pump 142 is activated by supplying electrical power thereto. Pump 142 draws fluid into inlet 144 and directs the fluid through check valve 140. The fluid is then directed into header 132 via tee-connection 138. The fluid then fills header 132 and passes out through ends 134,136 and into hoses 112,113, which in turn communicates the fluid with load tank 104, and load tank 104 begins to fill with water. Air escapes through aperture 111, thus equalizing the pressure within load tank 104 throughout the filling process. When load tank 104 is pumped with a desired level of water, pump 142 is shut-off by disconnecting the electrical power.

It will now be apparent that a variety of means can be used to determine when load tank 104 is full. For example, a transparent window can be placed on the exterior of load tank 104 to allow a weight-lifter to visually determine when load tank 104 is at a desired level. Alternatively, the flow-rate of pump 142 can be determined, and pump 142 can be set on a timer which automatically shuts-off after a given duration, based on the determined flow-rate. Load tank 104 can also be provided with a fluid-pressure transducer located in the lower portion of tank 104 or within one or both hoses 112,113. Such a pressure transducer can provide a visual read-out to a weight-lifter using device 100, or it can also be connected to pump 142 such that pump 142 automatically shuts off when a given water-pressure, which correlates with a certain level of fluid in tank 104, is reached. Other means to determine the desired level of load tank 104 can be used, as will occur to those of skill in the art.

Having filled tank 104 to a desired level and shut-off pump 142, water within tank 104 is prevented from draining back into charge tank 108 by check-valve 140 and ball-valve 146. When the weight-lifter decides to begin his exercise, ball-valve 146 is opened, allowing fluid to drain from tank 104, down through hoses 112, 113, into header 132, through ball-valve 146 and out of outlet 150 back into charge tank 108. At this point, the weight-lifter begins his exercise, repeatedly lifting and lowering the selected portion of stack 32 and load tank 104. Through-out the exercise, the overall weight being lifted by the weight-lifter will decrease as the level of water within load tank 104 drops. Accordingly, the weight-lifter should experience a decrease in weight during each repetition so that he is lifting his capacity during the repetition. The weight-lifter continues his exercise until load tank 104 is completely drained.

Figure 19:
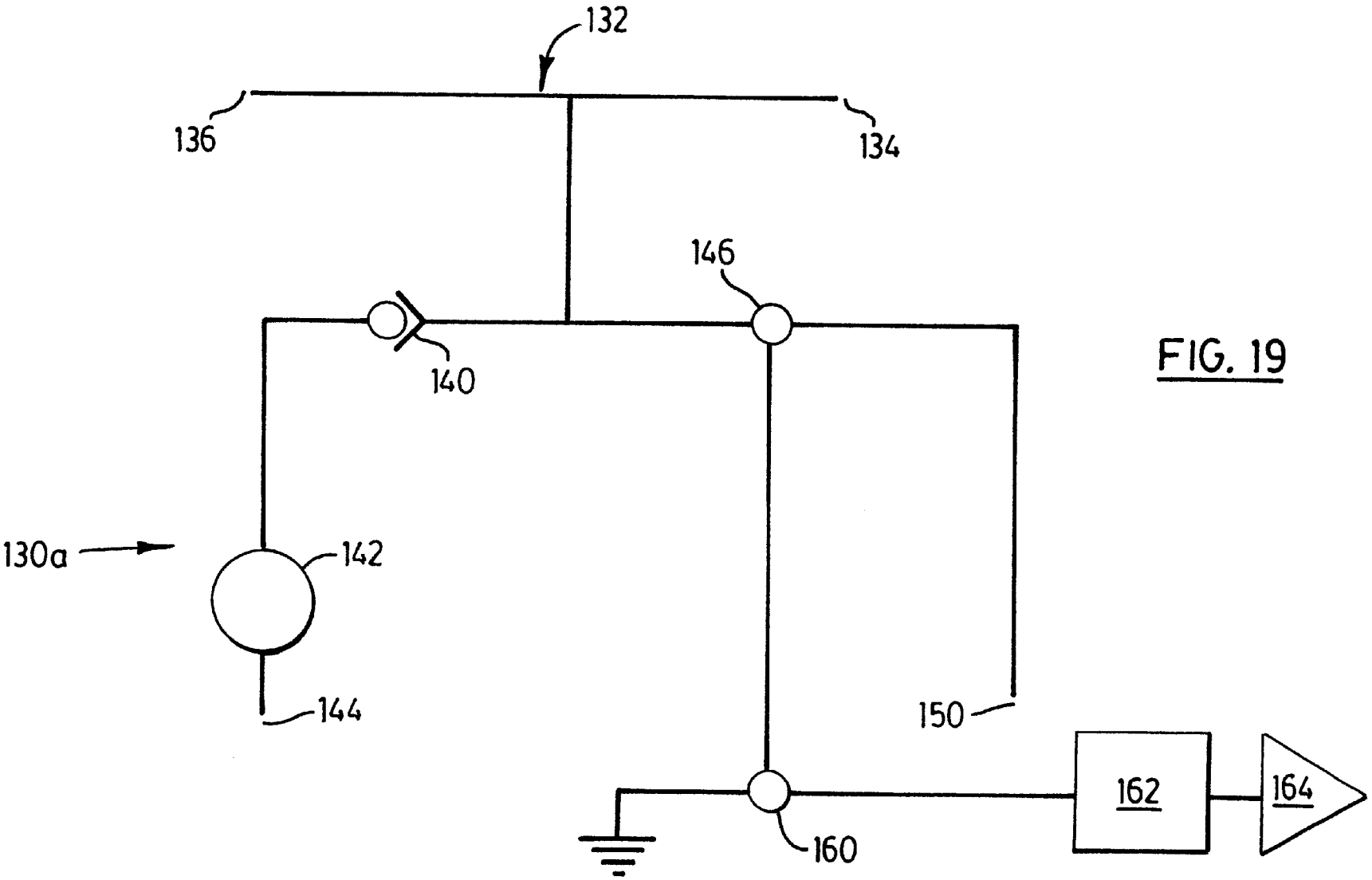
FIG. 19 is a schematic diagram of a fluid-control means in accordance with another embodiment of the invention.
Figure 20:
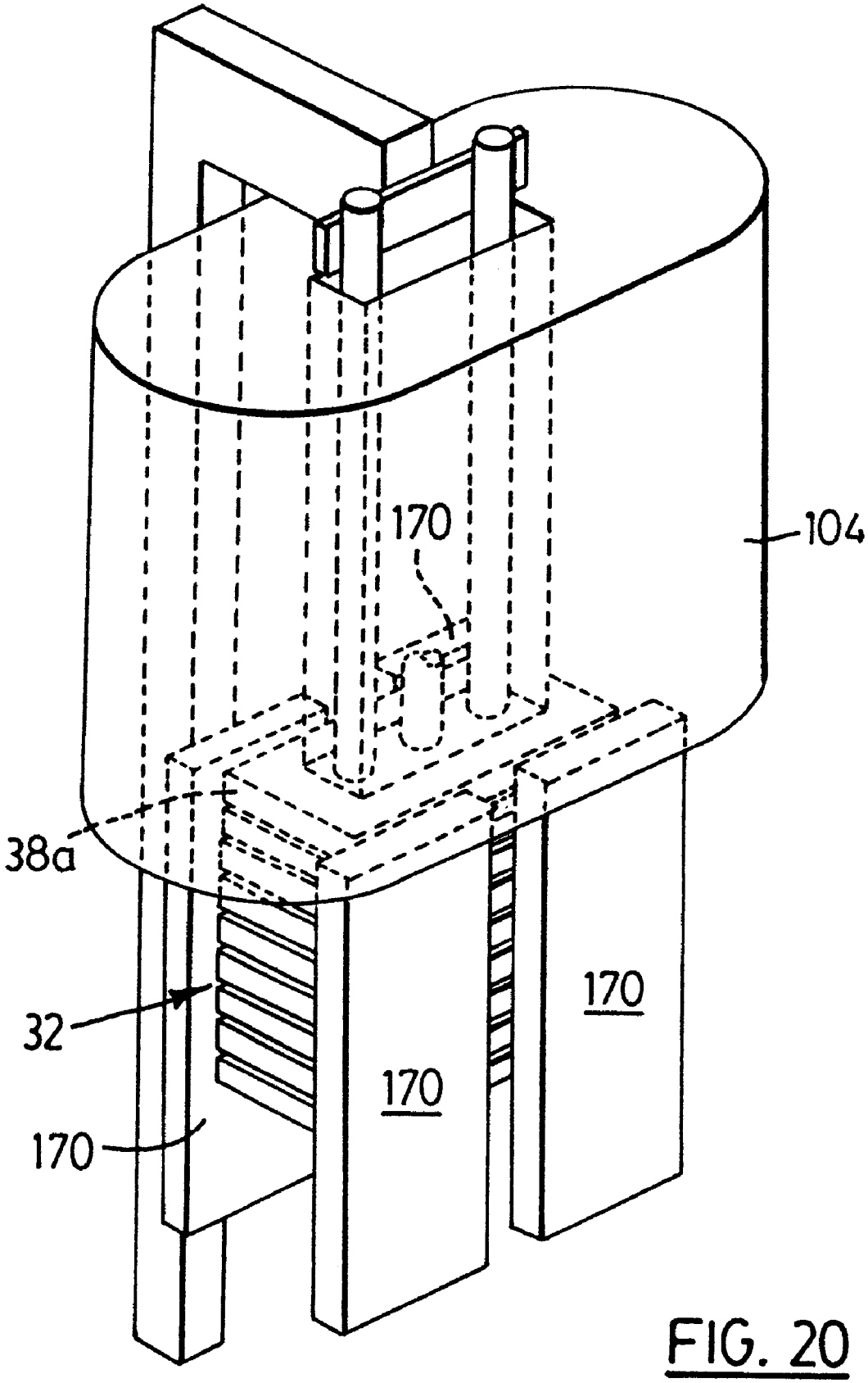
FIG. 20 is a partial front perspective view of a weight-lifting device in accordance with another embodiment of the invention.
Figure 21:
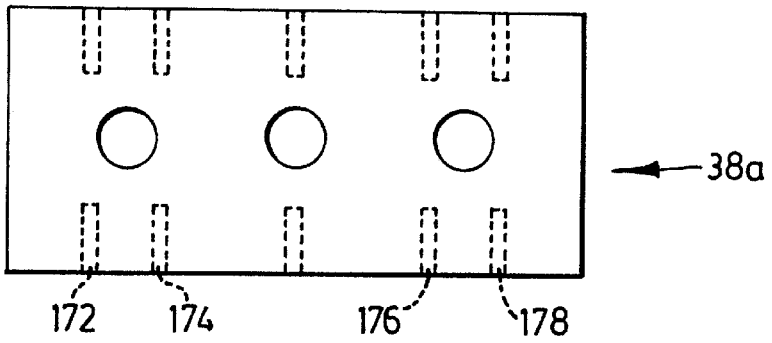
FIG. 21 is a top view of an adaptor plate used in the device of FIG. 20.
Figure 22:
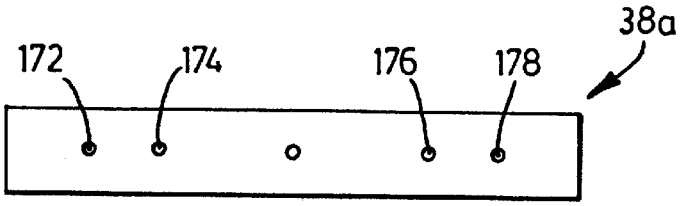
FIG. 22 is a front view of an adaptor plate of FIG. 21.

Referring now to FIG. 19, in another embodiment of the invention, handle 148 is eliminated so that ball-valve 146 can be automatically actuated with a servo-motor 160 connected to a controller 162 and a feedback transducer 164. (Other types of automatically actuated valves will occur to those of skill in the art.) Such a feedback transducer could include a pressure transducer mounted within one or both of hoses 112, 113 that monitors the amount of pressure therein during each repetition. Because the pressure transducer will show an increase in pressure during each lift of stack 32, the controller can monitor whether stack 32 is being lifted to a predetermined height. If the predetermined height is not being reached, the controller can ascertain that the amount of weight exceeds the weight-lifter's capacity and accordingly increase the drainage from tank 104 by actuating the servo-motor and further opening ball-valve 146. Similarly, if the predetermined height is being reached too quickly, or is being exceeded, then the controller can close ball-valve 146 and decrease the amount of drainage until the controller detects the predetermined height is not being exceeded or reached too quickly.

Other feedback transducers 164 can include bio-feedback transducers. For example, a heartrate monitor can be used to vary the rate of drainage from tank 104 to effect a preprogrammed desired exercise. Alternatively, a transducer to detect muscle movement, such as a electromyographical (EMG) electrodes commonly used in physiotherapy, can be attached to the muscle being worked by the movements of the particular mechanical interface attached to machine 20. EMG electrodes can measure the "activation" of the target muscle, and accordingly, monitor the amount of muscle fatigue experienced by the target muscle. Thus the flow-rate from the tank can be modified as muscle-fatigue is detected by controller 162.

Another feedback transducer 164 can be a strain gage incorporated into, for example, tension line 40. Another feedback transducer 164 can be a flow-metre placed between tee-connection 138 and outlet 150. Suitable flow-metres include the Dwyer Series RMV II or Series RMV, made by Dwyer Instruments, PO Box 373 Michigan City, Ind. 46361, suitably modified to provide input to controller 162. Other types of feedback transducers 164 can be used, as will occur to those of skill in the art. Furthermore, it will be apparent that one or more different types of feedback transducers 164 can be connected to controller 162 to provide further data to controller 162.

Controller 162 can be further equipped with user-input devices to allow a weightlifter to enter his or her physical parameters and/or a desired weight-lifting program that can be used by controller 162 to tailor the weightlifter's workout to his or her particular needs and/or desires.

It is contemplated that controller 162 can be connected to a persistent storage device such as a floppy-disc drive, which is operable to store historical data of a particular weight-lifter.

In another embodiment of the invention, information detected and/or stored by controller 162 can be delivered to an output device such as a monitor or speakers or the like. For example, information detected by controller 162 can be delivered as a voice message which offers encouragement, such as "push harder" or "make sure you lower the stack all the way". Other feedback can be presented or delivered to the weightlifter, as will occur to those of skill in the art. The present embodiment can be incorporated into a complete "virtual trainer", which assists the weightlifter through an entire program. It is further contemplated that the virtual trainer can be programmed with the voice and/or visual images of professional athletes or other well-known celebrities.

Figure 23:
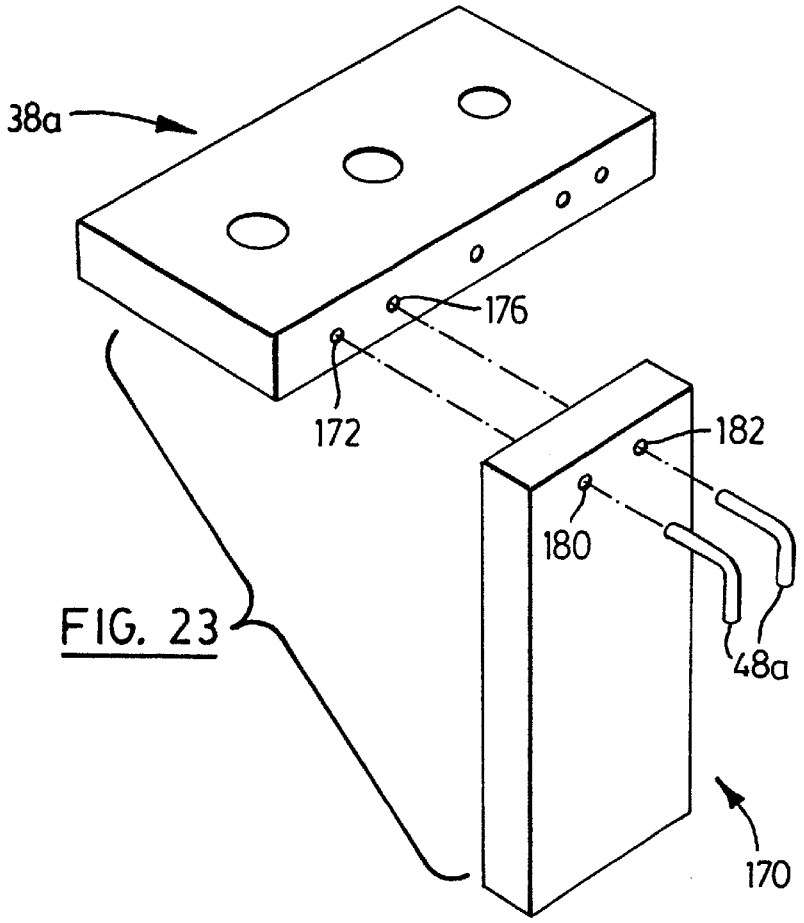
FIG. 23 is an exploded view of the adaptor plate and additional weight of the device of FIG. 20.

Referring now to FIGS. 20–23, in another embodiment of the invention, additional weights can be added to stack 32 which can replace weights 38 that are removed from guide shafts 30 to accommodate load tank 104 when device 100 is fitted, or retrofitted, onto machine 20. In a present embodiment, four additional weights 170 are attachable to an adaptor plate 38*a* placed on the top of stack 32 and below load tank 104. The adaptor plate 38*a* is provided with four additional sockets 172, 174, 176, 178 which are substantially parallel with and identical to socket 46. Weights 170 are each provided with two apertures 180, 182 which align with sockets 172, 174 respectively and/or sockets 176, 178 respectively. As best seen in FIG. 23, each additional weight 170 can be attached to adaptor plate 38*a* with a modified pin 48*a* inserted into each aperture 180, 182 and their respective socket 172, 174. Modified pin 48*a* is substantially identical to pin 48, but can be modified to ensure proper retention of weight 170 to adaptor plate 38*a*. For example, pin 48*a* can be long enough to pass through the entire length of each socket 172, 174, 176, 178 and be provided with a thread on the opposite end to receive a nut to thus fasten each weight 170 to adaptor plate 38*a*. The present embodiment may be particularly suitable for weight-lifters with a very high capacity, and thus the extra weights 170 can be used to ensure such weight-lifters reach their capacity throughout their exercise. It will be apparent that a suitably modified adaptor plate 38*a* can also be used as a guide plate.

Figure 24:
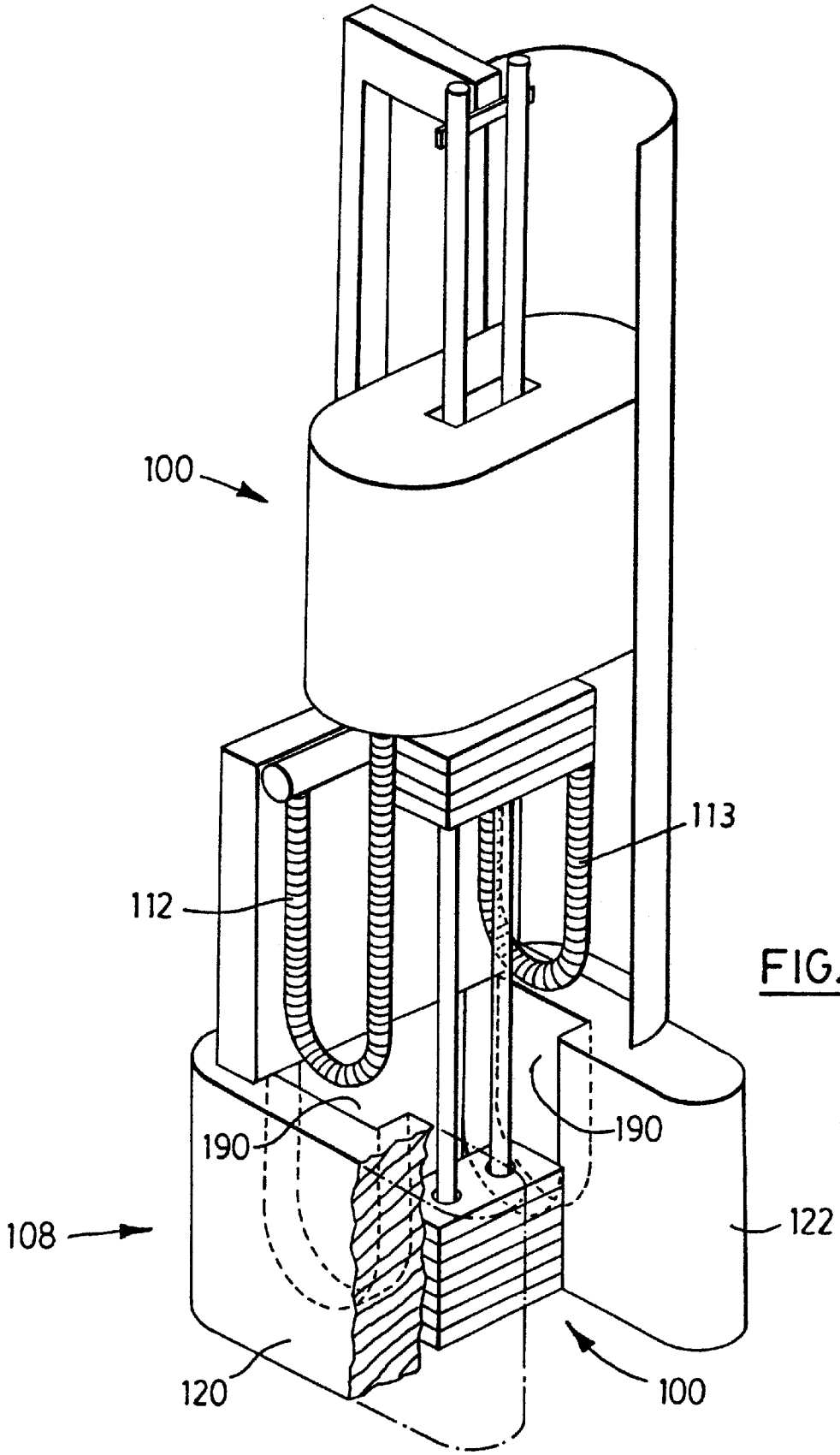
FIG. 24 is a front perspective view of a weightlifting device in accordance with another embodiment of the invention.

Referring now to FIG. 24, in another embodiment of the invention, charge tank 108 can be provided with recesses 190 on each side portion 120, 122, which can receive hoses 112, 113 when device 100 is in the lowered position, thus decreasing the likelihood of hoses 112, 113 becoming tangled with device 100 and machine 20

Figure 25:
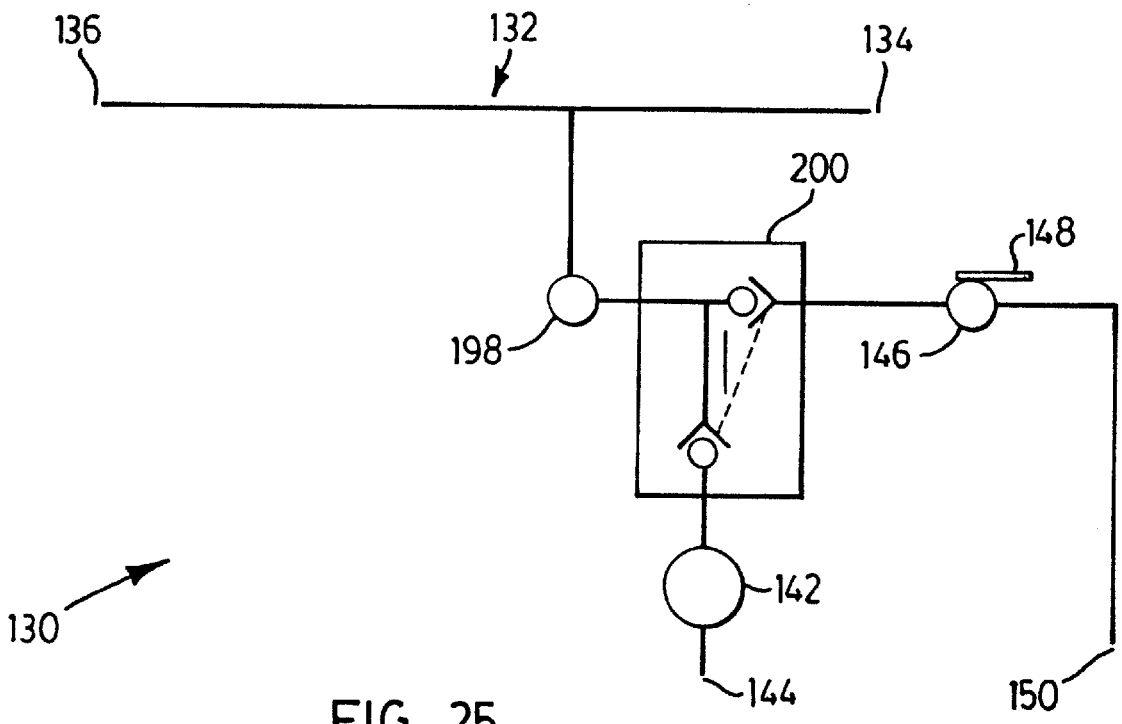
FIG. 25 is a schematic diagram of a fluid-control means in accordance with another embodiment of the invention.
Figure 26:
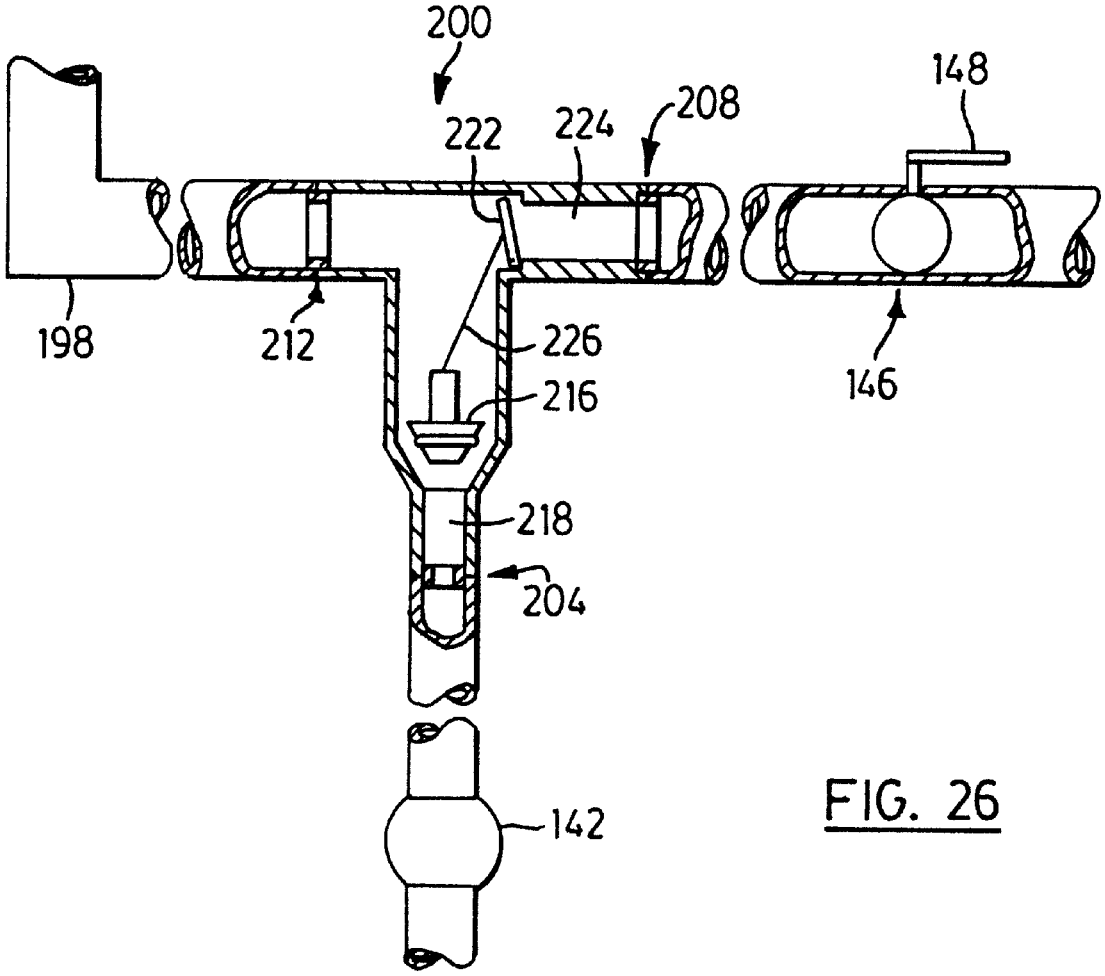
FIG. 26 is a sectional view of the double check valve shown in FIG. 25.

Another embodiment of the invention is shown in FIGS. 25 and 26, having a modified fluid control means 130. Components in fluid control means 130 having the same component in fluid control means 130 are indicated with like references. Fluid control means 130b includes a hollow header 132 which resides within raised portion 124 and is connected at each of its ends 134, 136 to hoses 112, 113 respectively.

Header 132 is connected to an elbow 198 that is connected to a double check-valve 200. Check-valve 200 branches in a first direction towards to pump 142, which in turn is connected to inlet 144. Double check-valve 200 branches in a second direction towards ball valve 146, which in turn is connected to outlet 150.

Referring now to FIG. 26, an exemplary double check valve 200 is shown in greater detail. Check valve 200 has an inlet 204 for connection to pump 142, and an outlet 208 for connection to ball-valve 146 and an opening 212 for connection to elbow 198. A first stopper 216 resides within the passage-way 218 adjacent to inlet 204. First stopper 216 has a tapered bottom and a gasket therearound. Check valve 200 is preferably oriented as shown in the drawings, so that inlet 204 is pointing downwards. Thus, first stopper 216 has a closed position wherein gravity draws stopper 216 downward so that it cuts off fluid communication between inlet 204 and opening 212. When pump 142 is operating, the water pressure therefrom is sufficient to overcome the force of gravity acting on stopper 216, so that it is raised into an open position, thereby allowing fluid to flow into inlet 204.

A second stopper 222 is pivotally attached to the passageway 224 adjacent to outlet 208.

Second stopper 222 has a closed position which cuts off fluid communication between outlet 208 and opening 212, and an open position which allows fluid communication therebetween.

A linkage 226 interconnects first stopper 216 and second stopper 222. When pump 142 is operating, first stopper 216 is raised into the open position and linkage 226 urges second stopper 222 into the closed position, thus allowing fluid to flow from inlet 204 and out of opening 212, thus allowing the filling of load tank 104. When pump 142 is off, gravity acts on first stopper 216 drawing it into the closed position. The linkage thus pulls on second stopper 222 drawing it into the open position, thus allowing the drainage of fluid from load tank 104 into opening 212 and out of outlet 208. Double check valve 200 can be particularly useful so that it is unnecessary to close ball valve 146 during filling of load tank 104. Other suitable double check valves 200 will occur to those of skill in the art.

In another embodiment of the invention, there is provided a method for weight training comprising the following steps. First, a base load for a weightlifter is selected on weight stack 32 by inserting selector pin 48 into an aperture on an appropriate one of weights 34. The total weight of the portion of stack 32 between the selected weight 34 and tension line 40 is the base load. It is believed that a base load of between about two percent to about eighty percent of the weightlifter's capacity can be selected. It is believed that a base load of between about twenty-five percent to about sixty percent of the weightlifter's capacity should be selected. As used herein, 'weightlifter's capacity' and 'weightlifting capacity' generally refers to the maximum amount of weight a weight-lifter can lift, once, on a given weightlifting machine, before muscle fatigue prevents another repetition of the same amount of weight. Preferably, a base load of between about thirty percent to about fifty percent of the weightlifter's capacity should be selected. More preferably, a base load of between about forty percent to about fifty percent of the weightlifter's capacity should be selected.

Generally, the amount of the base load is determined based on the endurance, personal strength of the weightlifter and the particular muscle group being worked by the exercise.

In the second step, pump 142 is activated to fill load tank 104.

Third, the weightlifter performs a predetermined number of warm-up repetitions during the filling of load tank 104. (As used herein, the term "repetition" refers to a cycle of lifting and lowering one or more weights.) It is believed that the number of warm-up repetitions can be less than about ten repetitions. Preferably, the number of warm-up repetitions can be less than about five repetitions. More preferably, the number of warm-up repetitions is between about one repetition and about three repetitions.

Fourth, pump 142 is deactivated when a desired level of weight of load tank 104 is obtained and when the predetermined number of warm-up repetitions have been completed. Accordingly, a flow rate for pump 142 is determined based on the desired level of weight of load tank 104 and the predetermined number of warm-up repetitions. (Thus, it can be desired to have a pump with a variable flow rate.) The deactivation of pump 142 can be manual, or it can be automatic where pump 142 is attached to a computer or other type of controller, as will be apparent to those of skill in the art. It is believed that a desired level of weight can be chosen so that the combination of the base load and the filled weight of load tank 104 is between about seventy percent to about one hundred percent of the weightlifter's capacity. More preferably, the desired level of weight is chosen so that the combination of the base load and the filled weight of load tank 104 is between about eighty percent to about one hundred percent of the weightlifter's capacity. Even more preferably, the desired level of weight is chosen so that the combination of the base load and the filled weight of load tank 104 is between about ninety percent and about one hundred percent of the weightlifter's capacity. It is presently preferred, however, that the desired level of weight of load tank 104 is chosen that the combination of the base load and the filled weight of load tank 104 is about one hundred percent of the weightlifter's capacity.

Fifth, the weightlifter begins to perform an exercise set or a predetermined number of exercise repetitions, and valve 146 is opened so that load tank 104 is drained. Load tank 104 is drained at a rate such that the weight being lifted during each exercise repetition is reduced to a predetermined weight. It is presently preferred that the predetermined weight decreases during each repetition such that it corresponds with the reduced capacity of the weightlifter due to muscle fatigue caused by the previous repetition.

It is believed that the predetermined number of exercise repetitions can be from about three repetitions to about twenty repetitions. Preferably, the predetermined number of exercise repetitions is from about four repetitions to about eighteen repetitions. More preferably the predetermined number of exercise repetitions is from about six repetitions to about fifteen repetitions. It is presently preferred that the predetermined number of exercise repetitions is from about eight repetitions to about twelve repetitions.

In order to vary the workout, it can be desired to intersperse some repetitions with occasional rests, which generally last the duration of a single repetition. Alternatively, or in addition to the rest pauses, it can be desired to perform one or more partial repetitions, in lieu of a full repetition, by setting the reduced weight to slightly exceed the weightlifter's capacity and thus achieve muscle overload.

Sixth, having completed the predetermined exercise repetitions and having drained load tank 104, the weightlifter can perform a predetermined number of final repetitions at the base load. It is believed that the predetermined number of final repetitions can be between about one repetition and about seven repetitions. Preferably, the predetermined number of final repetitions is between about two repetitions and about six repetitions. More preferably, the predetermined number of final repetitions is between about two repetitions and about four repetitions. It is presently preferred, however, that the predetermined number of final repetitions is between about two repetitions and about three repetitions. Generally, it can be desired to perform final repetitions until the weightlifter is unable to lift the base load.

It is contemplated that either or both of the warmup repetitions and the final repetitions can be eliminated from the foregoing method. It will be apparent that the final repetitions can be at a weight between the base load and the desired load, as desired, by not completely draining the load tank. Other variations on the foregoing method will occur to those of skill in the art.

While the previously described method is implemented using the weightlifting device described in previous embodiments, it will be understood that the method can be implemented using any machinery which effects substantially the same resistive forces experienced by the weightlifter during the exercise. For example, the same exercise cycle can be effected by a mechanical interface connected to an electric motor coupled with a computer controller. The controller can be programmed to generate substantially the same resistive forces in the same pattern as the previously described method.

While the embodiments discussed herein are directed to particular implementations of the present invention, it will be apparent that the sub-sets and variations to these embodiments are within the scope of the invention. For example, it will be apparent that the various embodiments described herein can be combined. Furthermore, the invention contemplates various devices and methods wherein a weightlifter could perform a single exercise involving a series of successive filling and draining of at least a portion of the load tank throughout the exercise.

The pump discussed in some of the previous embodiments can be eliminated by rigging the charge tank in a fashion so that it can be raised above the load tank, allowing the load tank to drain into the charge tank, and then lowering the charge tank below the load tank during the exercise.

It will be apparent that the invention discussed herein can be used as a form of medical treatment, typically by physiotherapists or similar practitioners, to recondition muscles.

A plurality of weightlifting devices can be connected to one central charge tank or other suitable water source, thus obviating the need for an individual charge tank for each device.

A pump can be used to assist in the draining of the load tank to provide even greater control over the drain rate.

The invention can be modified so that the load tank drains in linear or non-linear rates, as is best suited to the desired weightlifting exercise.

The present invention provides a novel weightlifting device which can be directly incorporated into or retrofitted onto a conventional weightlifting machine. The overall configuration of the machine will be familiar to weightlifters who currently use existing weight lifting machines. Further, gymnasiums already equipped with conventional weightlifting machines can simply retrofit their existing machines without the need to purchase additional equipment. The present invention provides an efficient work-out for a weight-lifter, by providing a means for the weight-lifter to lift his capacity of weight during each repetition. Thus, during each repetition, the weight-lifter can achieve the desired effect of the exercise in a reduced period of time. The use of feedback control can further improve the work-out, as the device dynamically adjusts to the capacity of the weightlifter by varying the reduction in the amount of weight through the exercise, as desired.

We claim:

1. A weightlifting device comprising:

a weight-stack attached to a mechanical interface for repetitious lifting and lowering by a weightlifter;

a load tank incorporated in said weight-stack;

a fluid source in fluid communication with said load tank; and a fluid-control means intermediate said load tank and said fluid source for filling said load tank with a fluid from said source and for draining said fluid from said load tank into said source such that an overall weight being lifted during said repetitive lifting and lowering is continually varied; wherein, said fluid control means includes provision for varying the rate at which said fluid drains into said tank.

2. The device according to claim 1 wherein said fluid-control means includes a valve having a closed position for preventing fluid from draining from said load tank into said fluid source and an open position for allowing fluid to drain from said load tank into said fluid source.

3. The device according to claim 1 wherein said fluid-control means includes a pump attached at one end to said fluid source and attached at the opposite end to said load tank, said pump being actuatable to draw fluid from said fluid source and directing said fluid into said load tank.

4. The device according to claim 3 wherein said fluid-control means includes a check valve for allowing fluid to flow from said pump to said load tank but preventing fluid from flowing from said load tank to said pump.

5. The device according to claim 3 wherein said fluid-control means includes a double check valve, said double check valve having a first position providing fluid communication between said pump and said load tank and a second position providing fluid communication from said load tank to said fluid source.

6. The device according to claims 3 wherein said fluid-control means includes at least one feedback transducer attached to said device for monitoring said weightlifter's performance.

7. The device according to claim 6 wherein said fluid-control means further comprises a controller for receiving data from said feedback transducer and for varying a rate of one or both of said draining and said filling based on an operation that considers at least in part said performance.

8. The device according to claim 6 wherein said at least one feedback transducer is a strain gage and said fluid-control means further comprises a servo-controlled valve operably connected to said controller for actuation thereby.

9. The device according to claim 6 wherein said at least one feedback transducer is an electromyographical (EMG) electrode.

10. The device according to claim 6 wherein said device further includes at least one user output device for presenting data to said weightlifter.

11. The device according to claim 10 wherein said data is presented in the form of audio and visual images representing a celebrity.

12. A weightlifting device comprising:

a frame having a base, a support arm and a support member connecting said base and said support arm;

at least one guide shaft intermediate said base and said support arm, said at least one guide shaft being substantially parallel to said support member;

a stack of weights slidable along said at least one guide shaft;

a selector rod having a plurality of sockets, each of said weights having an aperture that aligns one of said sockets;

a tension line attachable at one end to said selector rod and at the opposite end to a mechanical interface, said mechanical interface operable to allow a weightlifter to repetitively lift and lower at least a portion of said stack when a pin is inserted into one of said apertures and said socket in alignment therewith;

a hollow load tank that rests on said stack such that said hollow load tank can be lifted and lowered i75 n conjunction with said stack;

a charge tank proximal to said base, said charge tank for holding a liquid;

at least one hose connecting said load tank to a header in said charge tank, said hose for communicating said liquid between said load tank and said charge tank;

a pump having an outlet attached to said header and an inlet in communication with said fluid in said charge tank;

a variable valve having an inlet in communication with said charge tank, said valve having a closed position to prevent fluid from draining from said load tank into said charge tank, an open position to allow fluid to drain from said load tank into said charge tank and being variable therebetween;

said pump being operable to pump a desired amount of said fluid from said charge tank into said load tank and said charge tank at a desired rate which is presettable by said weightlifter while said weightlifter performs at least one repetition such that the overall weight being lifted by said weightlifter during each repetition is varied.

13. A kit of parts for retrofitting onto a weightlifting machine having a weight-stack and a mechanical interface for repetitive lifting and lowering by a weightlifter, said kit comprises:

a load tank for incorporation into said weight-stack;

a fluid source for connection in fluid communication with said load tank; and a fluid control means for placement intermediate said load tank and said source and for alternatively filing said load tank with a fluid from said source and draining said fluid from said load tank into said source at a selectable non-incremental rate such that an overall weight being lifted during said repetitive lifting and lowering is varied.

* * * * *